US005697591A

United States Patent [19]

Cooper

[11] Patent Number: 5,697,591

[45] Date of Patent: Dec. 16, 1997

[54] ORNAMENT HOLDER

[76] Inventor: Kenneth R. Cooper, 868 Duplex Avenue, Toronto, Ontario, Canada, M4R 2X2

[21] Appl. No.: 418,719

[22] Filed: Apr. 7, 1995

[51] Int. Cl.[6] ..... F21V 21/08

[52] U.S. Cl. ..... 248/229.16; 248/229.26; 362/123; 362/396; 403/391; 403/397

[58] Field of Search ..... 248/229.16, 229.26, 248/316.7; 362/123, 396, 457; 403/391, 397, 400

[56] References Cited

U.S. PATENT DOCUMENTS

| | | | |
|---|---|---|---|
| 1,343,767 | 6/1920 | Cuzen | 362/396 |
| 1,734,577 | 11/1929 | Henry | 248/316.7 X |
| 1,774,775 | 9/1930 | Weitz | 248/229.26 |
| 1,807,501 | 5/1931 | Alexander | 362/396 X |
| 2,494,881 | 1/1950 | Kost | 248/316.7 X |
| 2,523,785 | 9/1950 | Sereno | 403/400 X |
| 3,747,166 | 7/1973 | Eross | 248/229.26 X |
| 4,440,519 | 4/1984 | Pennel et al. | 403/391 |
| 5,288,047 | 2/1994 | Pan | 248/229.26 |

FOREIGN PATENT DOCUMENTS

| | | | |
|---|---|---|---|
| 1074238 | 1/1960 | Germany | 248/229.26 |

*Primary Examiner*—John A. Ricci
*Attorney, Agent, or Firm*—Bereskin & Parr

[57] ABSTRACT

A holder for securing ornamental lights to Christmas trees comprises a pair of generally cylindrical parts disposed mutually at right angles. Each part has a generally C-shaped cross-section with the openings in the two parts extending away from one another. Each part also has two arcuate gripper elements that curve inwardly of the cross-section of the part, for providing an improved gripping effect. In use, one part is clipped over a Christmas tree branch. The other part extends generally vertically and receives a bulb holder for a tree light, or other ornament.

4 Claims, 1 Drawing Sheet

FIG.1.
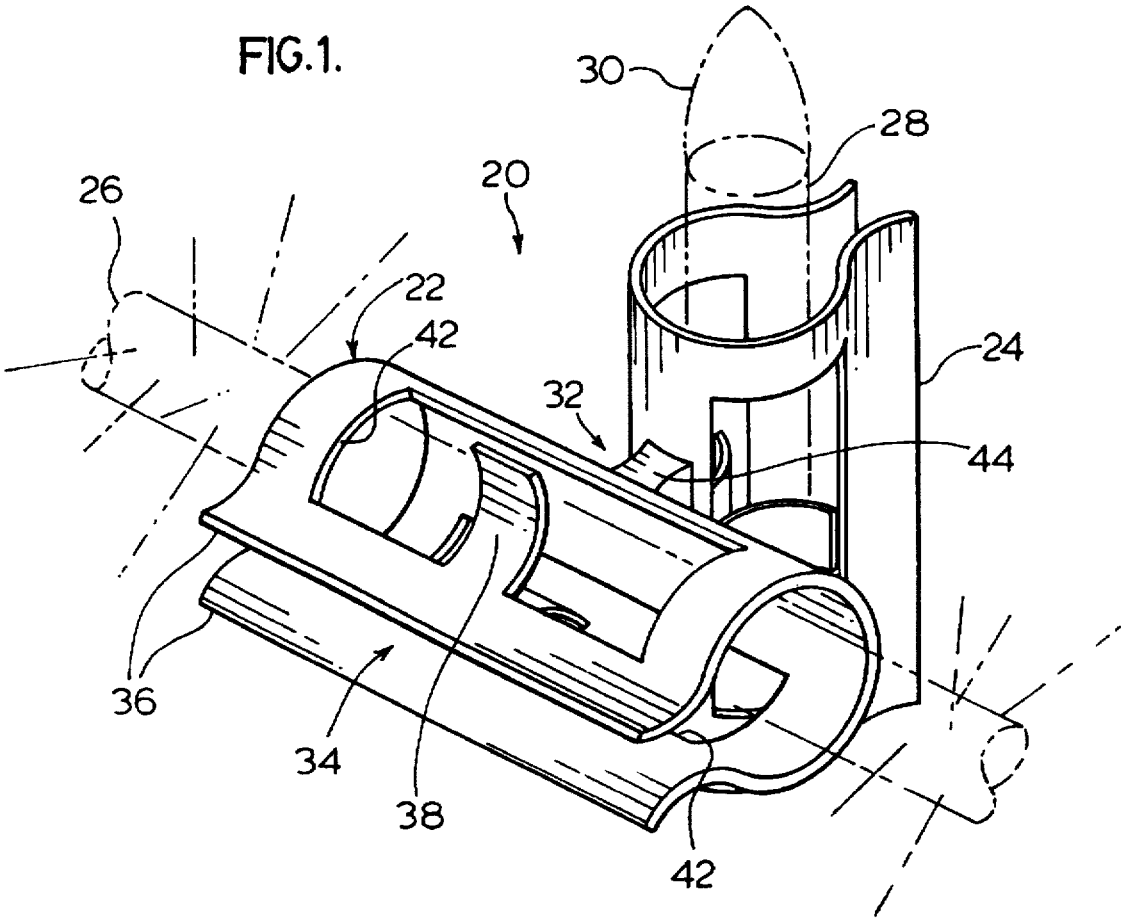
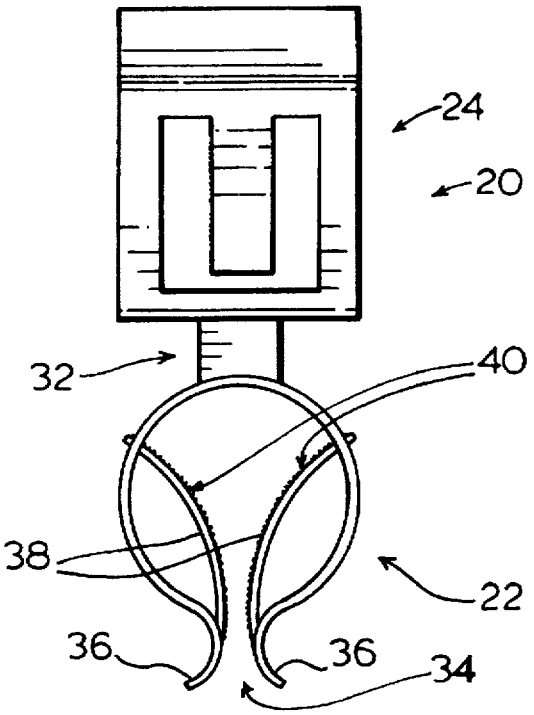
FIG.2.

ORNAMENT HOLDER

FIELD OF THE INVENTION

This invention relates generally to a device for holding ornaments or the like.

BACKGROUND OF THE INVENTION

The invention has been devised primarily (though not exclusively) in the context of securing ornamental lights or other ornaments to a Christmas tree. At present, there are no devices of which the inventor is aware, for performing this function. In particular, it would be desirable to be able to secure an ornamental light to a Christmas tree branch so that the light extends generally vertically, i.e. at right angles to the direction of the branch. However, it is difficult to achieve this orientation in practice.

Ornamental lights for Christmas trees generally are supplied in the form of a loop of wiring with bulb holders at intervals along the loop. The bulb holders are each generally of cylindrical form, with two adjacent portions of the wiring entering one end of the cylinder. The holders are not precisely oriented with respect to the wiring. As such, when the wiring loop is laid onto branches of a tree, the bulb holders tend to extend somewhat randomly from the wiring and it is difficult to precisely orient the holders with respect to the tree branches. In fact, experience has shown that the only practical way of achieving precise orientation is to physically wire the bulb holders to the branches. On a typical large Christmas tree that could have many dozens of ornamental lights, this is a very time-consuming and tedious task.

SUMMARY OF THE INVENTION

Accordingly, it is an object of the present invention to provide a device for holding ornaments such as tree lights or the like on a Christmas tree or other support, in which the ornament can be located with somewhat more precision than has conveniently been possible in the past.

According to the invention the ornament holder comprises a first part for engaging a support, and a second part for engaging an ornament or the like. The two parts are coupled together at a defined location on the first part and the first part has a generally cylindrical overall configuration with a longitudinally extending opening remote from the said defined location so that the first part has a generally C-shaped cross-section permitting that part to be frictionally fitted over a said support.

In a preferred embodiment of the invention, the first and second parts of the ornament holder are of similar configuration; that is, generally cylindrical but of C-shape in cross-section; and the openings of the respective parts face in opposite directions. The two cylinders may be oriented mutually at right angles, or may be pivotally coupled together so that the orientation can be changed.

In any event, in an embodiment in which the two parts are similar, the first part can simply be frictionally engaged over a tree limb or the like and the bulb holder or other ornament frictionally engaged in the second part. For example, the first part may extend generally horizontally in the direction of the tree limb, and the second part generally vertically so that a bulb holder can be snap-fitted into the part with the bulb pointing upwards.

The two parts of the holder may be made separately and joined together, or the parts could be moulded in one piece.

In an embodiment of the invention in which the two parts of the holder are not similar, the second part of the holder could in fact comprise a bulb holder for an ornamental tree light. In other words, the two parts of the holder could comprise a first part for engaging a tree branch or the like, and a second part which is the actual bulb holder.

DESCRIPTION OF PREFERRED EMBODIMENT

In order that the invention may be more clearly understood, reference will now be made to the accompanying drawings which illustrate a particular preferred embodiment of the invention by way of example, and in which:

FIG. 1 is a perspective view of an ornament holder shown in an orientation such as it might adopt in practice on a Christmas tree, in which a tree branch and ornamental bulb holder are both shown in ghost outline; and, FIG. 2 is an end elevational view showing a slightly modified form of holder.

DESCRIPTION OF PREFERRED EMBODIMENT

Referring first to FIG. 1, an ornament holder is generally denoted 20 and comprises a first part 22 for engaging a support, and a second part 24 for holding an ornament or the like. The first part 22 is shown clipped onto a branch or limb of a Christmas tree, shown in ghost outline at 26. A bulb holder of an ornamental light set is also shown in ghost outline at 28, engaged with the second part 24 of the ornament holder. A bulb in holder 28 is indicated at 30. FIG. 1 clearly shows how the ornament holder of the invention can be used to position the bulb holder 28 generally vertically with respect to a horizontal Christmas tree limb (26).

In this particular embodiment, the two parts 22 and 24 of the holder are essentially identical and are coupled together at a defined location indicated by reference numeral 32. Referring to the first part 22 by way of example, it will be seen that the part has a generally cylindrical overall configuration with a longitudinally extending opening or slot 34 remote from the defined location 32 at which the two parts are coupled together.

The end view of FIG. 2 shows a holder which is essentially identical with the holder shown in FIG. 1 except that the two parts 22 and 24 are of shorter axial length in FIG. 2 than in FIG. 1. Accordingly, the same reference numerals have been used in both views. FIG. 2 clearly shows the cross-sectional shape of the first part 22 and the fact that the opening 34 is in fact diametrally opposite to the defined location 32 at which the two parts are coupled together. Along both sides of the opening 34, the part 22 is flared outwardly as indicated at 36, to provide a smooth entry to the opening 24. This facilitates frictional engagement of the part over a tree branch or other support in that the flared surfaces will tend to ride over the surface of the branch, opening up the part and allowing it to in effect snap onto the branch.

In this particular embodiment, two arcuate gripper elements 38 extend inwardly from opposite sides of part 22 (laterally of opening 34 and location 32) to engage the tree limb or other support, for further assisting frictional retention of the holder on the support. Saw-tooth or otherwise roughened surfaces 40 are provided on the gripper elements 38 for further assisting this frictional effect.

In this example, part 22 has two generally rectangular openings 42 in respectively opposite sides thereof, and the gripper elements 38 are provided in these openings. As shown, each of the elements 38 is in the nature of a finger or flap having a free distal end and an inner end at which the element adjoins the remainder of the part. In some situations, this may be a convenient way of making the part, but it is not essential to the invention. In fact, it should be noted that the gripper elements 38 are optional in any event.

As noted previously, part 24 is essentially identical with part 22; part 24 will not therefore be described in detail. In this embodiment, the two parts are oriented mutually at right angles and are interconnected at location 32 by a pin or block 44.

Also as noted previously, the holder may be integrally formed in one piece, for example, as a plastic moulding. Another possibility is that the two parts 22 and 24 may be made separately and joined together, again possibly as plastic mouldings. Alternatively, the parts 22 and 24 could be metal formings, or made as wire cages or other fabrications. Where the two parts are made separately, they may for example be bolted, rivetted or secured together in any other convenient fashion. It would be possible to provide a swivel connection between the two parts so that their mutual orientation could be changed.

It should also again be noted that the second part 24 of the holder could be of a completely different form than the first part. For example, part 24 could be made the actual bulb holder.

It should also be noted that the precise configuration and form of the holder as shown in the drawings is given by way of example only and that many modifications are possible within the broad scope of the invention. While specific reference has been made to a holder for ornamental lights on Christmas trees, there is no limitation in either of these respects. The holder could be engaged with any other form of support, for example, a rod or like element on some other ornamental fixture. Similarly, ornaments other than bulb holders could be engaged in the second part 24 of the holder.

I claim:

1. An ornament holder comprising a first part for engaging a support and a second part for holding an ornament, wherein each of said first and second parts has a generally cylindrical overall configuration with a longitudinally extending opening therein, whereby each part has a generally C-shaped cross-section for permitting the first part to frictionally engage a support and permitting said second part to frictionally engage an ornament, wherein said first and second parts are coupled directly together at a defined location such that the longitudinally extending opening in each part is diametrally opposed to said location as seen in cross-section, and wherein each said part further comprises a pair of arcuate gripper elements extending inwardly of the cross-section of the part on respectively opposite sides of said opening, for frictionally engaging a support within the first part and an ornament within the second part, each said arcuate gripper element having a curvature opposite to the curvature of the portion of the C-shaped part from which it extends inwardly.

2. An ornament holder as claimed in claim 1, wherein portions of each said part on both sides of said openings are flared outwardly to facilitate engagement of the first part with a support and the second part with an ornament.

3. An ornament holder as claimed in claim 1, wherein said gripper elements have inner surfaces that are toughened for enhanced frictional retention.

4. An ornament holder as claimed in claim 1, wherein said first and second parts are oriented generally mutually at right angles with respect to one another.

* * * * *